US005282567A

United States Patent [19]

Dickson

[11] Patent Number: 5,282,567

[45] Date of Patent: Feb. 1, 1994

[54] TRANSPORT AND DISPLAY CARTON

[75] Inventor: Dane Dickson, Pleasanton, Calif.

[73] Assignee: The Clorox Company, Oakland, Calif.

[21] Appl. No.: 971,438

[22] Filed: Nov. 3, 1992

[51] Int. Cl.[5] ..... B65D 5/48

[52] U.S. Cl. ..... 229/120.25; 229/120.26; 229/120.29; 229/120.36

[58] Field of Search ..... 229/120.24, 120.25, 229/120.26, 120.29, 120.36, 120.37, 120.38; 217/23, 30, 31, 32, 33

[56] References Cited

U.S. PATENT DOCUMENTS

| | | | |
|---|---|---|---|
| 284,252 | 9/1883 | Smith | 217/33 |
| 1,235,886 | 8/1917 | Fenlason | 229/120.36 |
| 1,665,620 | 4/1928 | Amatel . | |
| 2,180,691 | 11/1939 | Olivier | 206/44 |
| 2,423,332 | 7/1947 | Mayer | 229/15 |
| 2,473,766 | 6/1949 | Richey | 229/42 |
| 2,535,289 | 12/1950 | Hopp et al. | 229/120.36 |
| 2,628,762 | 2/1953 | Spalding | 229/120.25 |
| 2,900,120 | 8/1959 | Wichman | 229/15 |
| 2,925,209 | 2/1960 | Wasyluka | 229/15 |
| 3,039,667 | 6/1962 | Kozlik | 229/120.36 |
| 3,209,979 | 10/1965 | Ziegfeld | 229/15 |
| 3,348,667 | 10/1967 | Beeby | 206/45.33 |
| 3,480,196 | 11/1969 | De Simas | 229/23 |
| 3,664,494 | 5/1972 | Mergens | 206/44 |
| 3,669,251 | 6/1972 | Phillips, Jr. | 206/44 |
| 3,702,170 | 11/1972 | Adams | 229/15 |
| 3,770,184 | 11/1973 | Rockefeller | 217/23 |
| 3,770,186 | 11/1973 | Kupersmit | 229/23 |
| 3,786,914 | 1/1974 | Beutler | 206/44 |
| 3,858,526 | 1/1975 | Lombard et al. | 108/51 |
| 3,946,883 | 3/1976 | Beal | 214/152 |
| 3,949,874 | 4/1976 | Heavner | 206/386 |
| 3,961,706 | 6/1976 | Roccaforte et al. | 206/44 |
| 4,011,943 | 3/1977 | Galli et al. | 206/44 |
| 4,201,138 | 5/1980 | Cox | 108/55.1 |
| 4,251,020 | 2/1981 | Schwaner | 229/15 |
| 4,335,842 | 6/1982 | Bradford et al. | 229/15 |
| 4,361,264 | 11/1982 | Philips | 229/120.36 |
| 4,363,405 | 12/1982 | Christie | 206/554 |
| 4,382,504 | 5/1983 | Vesborg | 206/44 |
| 4,574,945 | 3/1986 | Giblin | 206/44 |
| 4,635,795 | 1/1987 | DeFlander et al. | 206/526 |
| 4,641,746 | 2/1987 | Dornbusch et al. | 206/44 |
| 4,697,699 | 10/1987 | Schneider | 206/44.11 |
| 4,705,162 | 11/1987 | Kupersmit | 206/45.11 |
| 4,953,702 | 9/1990 | Bryan | 206/432 |
| 5,004,146 | 4/1981 | Thominet et al. | 229/120.37 |
| 5,048,690 | 9/1991 | Zimmerman | 206/602 |
| 5,145,060 | 9/1992 | Maye | 206/45.14 |

FOREIGN PATENT DOCUMENTS

| | | | |
|---|---|---|---|
| 1536243 | 1/1970 | Fed. Rep. of Germany | 229/120.36 |
| 1175703 | 4/1959 | France | 229/120.36 |
| 2636920 | 3/1990 | France | 229/120.25 |
| 464060 | 4/1937 | United Kingdom | 229/120.36 |
| 2055349 | 3/1981 | United Kingdom | 229/120.36 |

*Primary Examiner*—Gary E. Elkins

*Attorney, Agent, or Firm*—Harry A. Pacini; John A. Bucher

[57] ABSTRACT

A transport and display carton is formed from a first generally rectangular element forming a bottom panel for the carton, a second elongated rectangular element including five segments and four interconnecting generally right angle folds and dividing the bottom panel into three generally equal areas, and a third rectangular element having a first straight segment intersecting two parallel segments of the first element and extending substantially along the length of the bottom panel to divide it into six exposed cells for receiving articles to be transported and displayed, the second and third elements being of substantially the same height on the bottom panel to provide structural rigidity for the carton.

4 Claims, 3 Drawing Sheets

TRANSPORT AND DISPLAY CARTON

FIELD OF THE INVENTION

The present invention relates to a transport and display carton and more particularly such a transport and display carton forming exposed cells for receiving articles to be transported and displayed.

BACKGROUND OF THE INVENTION

Shipping cartons of the type contemplated by the present invention are commonly employed both for transport and display of articles transported within the cartons. The articles may be any of a wide variety but typically are household products such as liquid containers.

The use of cartons for both transport and display at a point of sale of the same articles is particularly common in warehouse clubs and the like where large volumes of similar articles are displayed for sale. In such operations, it is common to transport large numbers of the articles in cartons on pallets with the palletized cartons forming a display for the articles at the point of sale in the warehouse type operation.

Where the articles being transported and displayed are relatively heavy, formation of the cartons in a display-ready mode during both transport and subsequent display becomes relatively difficult because of the need for assuring structural rigidity of the cartons. This is particularly true, for example, where the cartons are stacked upon each other on a pallet as described above.

For this reason, many shipping cartons tend to form a complete enclosure for the articles at least during transport. When the cartons reach the point of sale, they are then prepared for display, for example, by removing a cover, by removing panels or by folding or otherwise disposing of panels in order to facilitate display of the articles within the cartons and to permit their removal by consumers or the like as desired.

Accordingly, such prior art transport and display cartons have been relatively complex, commonly including complete box-like enclosure with partitions forming cells therein. Such cartons normally require the removal or manipulation of a portion of the carton in order to permit display of articles in the cartons upon arrival at a point of sale. In addition, the relative complexity of such cartons increases their cost and difficulty of assembling and filling with articles.

Furthermore, it has become common practice to arrange large number of cartons on pallets for both transport to the point of sale and for display. Particularly where the cartons contain relatively heavy articles such as liquid containers, the number of cartons stacked one upon the other is relatively limited. With the cartons arranged upon the pallet prior to transport, they are commonly wrapped together with the pallet by means of bands or transparent stretch-wrap. With the cartons stabilized on the pallets by means of the bands or stretch-wrap and reinforced by separate corner posts, they are then transported to the point of sale.

The bands or stretch-wrap are then readily removed at the point of sale and present only a limited amount of material for disposal. However, with the prior art cartons as noted above, substantial additional effort is required to further condition the individual cartons for display of articles contained therein and removal of the articles as desired.

SUMMARY OF THE INVENTION

Accordingly, there has been found to remain a need for further improvements in transport and display cartons of the type contemplated by the present invention. In particular, there has been found to remain a need for transport and display cartons which expose articles contained therein during transport, which are particularly simple in design to minimize cost and assembly and furthermore, which provide structural strength, particularly when stacked upon shipping pallets or the like.

Accordingly, it is an object of the invention to provide an improved transport and display carton meeting one or more of the criteria set forth immediately above.

It is a further object of the invention to provide such a transport and display carton formed from three rectangular elements including a first element forming a bottom panel for the carton, a second elongated rectangular elementincluding five segments and four interconnecting generally right angle folds to form a rectangular box and a third rectangular element having a first straight segment intersecting the box of the second element and extending substantially along the length of the bottom panel with end segments integrally forming right angle folds whereby the second and third elements form six exposed cells on the bottom panel for receiving articles to be transported and displayed, the second and third elements being substantially the same height when arranged on the bottom panel so that their right angle folds cooperated to provide structural rigidity for the carton.

Preferably, the bottom panel has a flange about its periphery so that the second and third elements can be arranged therein without requiring further interconnection with each other or with the bottom panel.

The carton also more preferably has opposing slots formed in the second and third elements at their points of intersection to facilitate their arrangement on the bottom panel and to form interacting joints further contributings to structural rigidity of the carton.

It is still further preferred that the end segments on the third element each include a second segment forming the right angle fold with the first segment and having a length about one half the corresponding dimension of the bottom panel.

It is a further related object of the invention to provide such a transport and display carton wherein the five segments of the second element are arranged on the bottom panel with two segments being parallel to each other and dividing the bottom panel into approximately three equal areas, the straight segment of the third element intersecting the two parallel segments of the second element to divide the bottom panel into six approximately equal exposed cells for receiving articles to be transported and displayed.

Other objects and advantages of the invention are made apparent in the following description having reference to the accompanying drawings.

DESCRIPTION OF THE PREFERRED EMBODIMENTS

Figure 1:
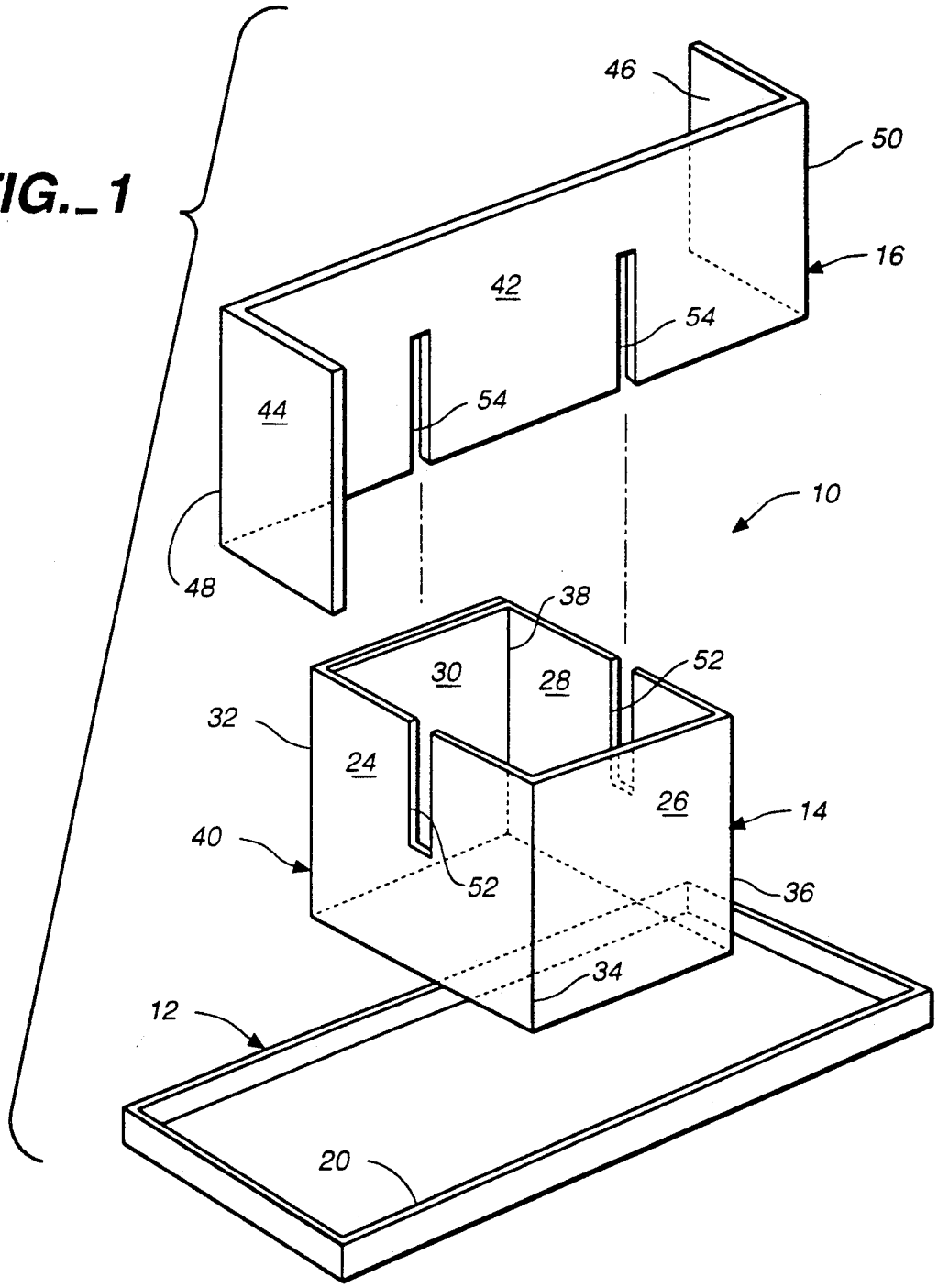
FIG. 1 is an exploded view of three separate rectangular elements suitable for arrangement with each other to form the transport and display carton of the present invention.
Figure 2:
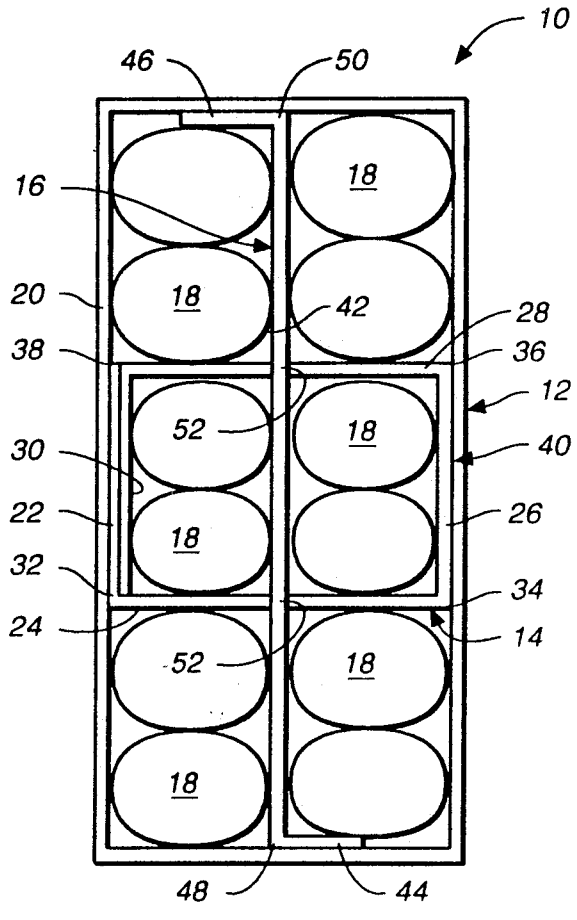
FIG. 2 is a plan view of the display carton of FIG. 1 with the three elements assembled together and containing articles to be transported and displayed.

Referring now to the drawings and particularly to FIGS. 1 and 2, the present invention is directed toward a transport and display carton generally indicated at 10 and adapted for formation in a particularly simple manner from three elements 12, 14 and 16 as described in greater detail below.

The rectangular configuration of the three elements simplifies and optimizes their formation from stock material such as corrugated board or the like while also minimizing and substantially eliminating any waste material during formation of the three elements.

Furthermore, the three elements are adapted for arrangement together in a particularly simple manner to facilitate construction of the carton and adapting it for forming multiple exposed cells suitable for both transport and display of articles such as liquid containers of the type indicated at 18 in FIG. 2.

Continuing with reference to FIGS. 1 and 2, the first element 12 is generally rectangular and, as noted above, forms a bottom panel of the carton having dimensions of length and width corresponding to those of the first element. Preferably, the first element 12 is formed with a flange 20 about its periphery. The flange 20 may be formed for example by folding up edge panels of the element 12 itself in a manner well known to those skilled in the art of transport and display cartons.

The second element 14 is an elongated rectangle integrally including five segments or panels 22, 24, 26, 28 and 30 interconnected by folds 32, 34, 36 and 38 adapted for forming right angle folds when the second element 14 is arranged on the first element 12 as illustrated in FIGS. 1 and 2.

Preferably, the two end segments 22 and 30 are arranged in overlapping relation to form one side of a box with one dimension corresponding to the length of the segments 24 and 28 and the other dimension corresponding to the length of the central segment 26 and the overlapping arrangement of end panels 22 and 30.

Preferably, one dimension of the box, for example, that formed by lengths of the segments 24 and 28 corresponds to a shorter dimension of the bottom panel formed by the first element 12. The other dimension of the box is preferably about one third the length or longer dimension of the bottom panel as illustrated in FIGS. 1 and 2.

A third element is also of rectangular configuration and is substantially elongated with a first straight segment arranged to intersect two segments 24 and 28 of the box 40 and extending along substantially the entire length of the bottom panel or first element 12 as illustrated in FIGS. 1 and 2. End segments are integrally formed on both ends of the first straight segment 42 as indicated at 44 and 46 in FIGS. 1 and 2. Right angle folds 48 and 50 are also formed respectively between the two ends segments 44, 46 and the straight segment 42. Accordingly, the second and third elements 14 and 16 interact with each other upon arrangement on the bottom panel formed by the first element 12 in order to divide the surface of the bottom panel into six approximately equal exposed cells suitable for receiving articles to be transported and displayed.

The height of the second and third elements 14 and 16 as arranged on the bottom panel of the first element 12 are substantially equal so that all of the rightangle folds formed by the two elements interact to provide substantial structural rigidity for the resulting carton.

Preferably, openings are formed at opposite ends of the first straight segment 42 in the third element so that a consumer or the like viewing the carton during display can see articles in all four end cells of the carton. Similar openings could be formed in portions of the second element 14 forming the box 40, if desired and for a similar reason.

In any event, the interaction of the first, second and third elements 12, 14 and 16 according to the present invention facilitates formation and assembly of the resulting carton 10 while providing a very effective and structurally rigid carton for both transporting and displaying articles such as those indicated at 18 in FIG. 2. As was also noted above, the design of the carton 10 minimizes waste material during formation of the carton and greatly minimizes time necessary to assembly and fill the carton.

It is preferably contemplated that the height of the carton as determined by the common height of the second and third elements 14 and 16 upon arrangement on the bottom panel of the first element 12 is greater than the height of the articles 18. Accordingly, it is particularly important that structural strength in a vertical direction be sufficient for supporting the weight of the carton and providing stacking strength when multiple cartons are stacked one upon the other on pallets (not shown) for transport and display. Such structural strength is provided in the present invention through the large number of integral right angle folds in the second and third elements.

Furthermore, the second and third elements are preferably formed with slots 52 and 54 respectively opposed to each other and extending approximately one half the height of the elements. The slots 52 and 54 are arranged at the point of intersection for the second and third elements to permit them to be readily assembled and interconnected as illustrated in FIGS. 1 and 2. The interconnection between the second and third elements provide additional structural strength for the resulting carton.

Figure 3:
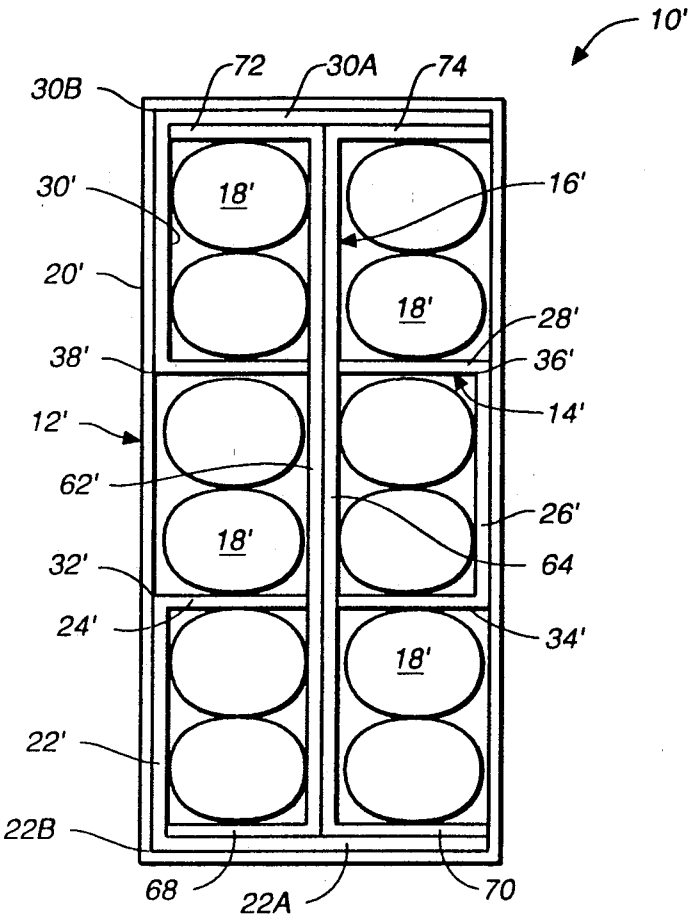
FIG. 3 is a plan view similar to FIG. 2 and illustrating an alternate embodiment of the transport and display carton.

Another embodiment of the carton is illustrated in FIG. 3 and includes elements generally similar to those described above with reference to FIGS. 1 and 2. Accordingly, components of the embodiment of FIG. 3A which correspond to elements in the embodiment of FIGS. 1 and 2 are indicated by primed numerals corresponding to those employed in FIGS. 1 and 2.

Referring particularly to FIG. 3, the carton 10' is also formed from first, second and third elements indicated respectively at 12', 14' and 16'. Principal differences from the embodiment of FIGS. 1 and 2 appear in the second and third elements 14' and 16' as described in greater detail below.

The second element 14' is preferably arranged with its segments 22' and 30' extending toward opposite ends of the first element 12' rather than overlapping each other as in the embodiment of FIGS. 1 and 2. Still further, additional segments 22A and 30A are formed on opposite ends of the second element 14' and are interconnected with the segments 22' and 30' respectively by right angle folds indicated at 22B and 30B. Accordingly, the end segments 22A and 30A are arranged across the shorter dimension of the first element 12 and parallel to its opposite ends.

Thus, referring particularly to FIG. 3, the second element is formed in generally a serpentine configuration with four segments 22A, 24', 28' and 30A being parallel to each other and adjacent pairs of the parallel segments being interconnected by the segments 22', 26' and 30'.

Figure 3B:
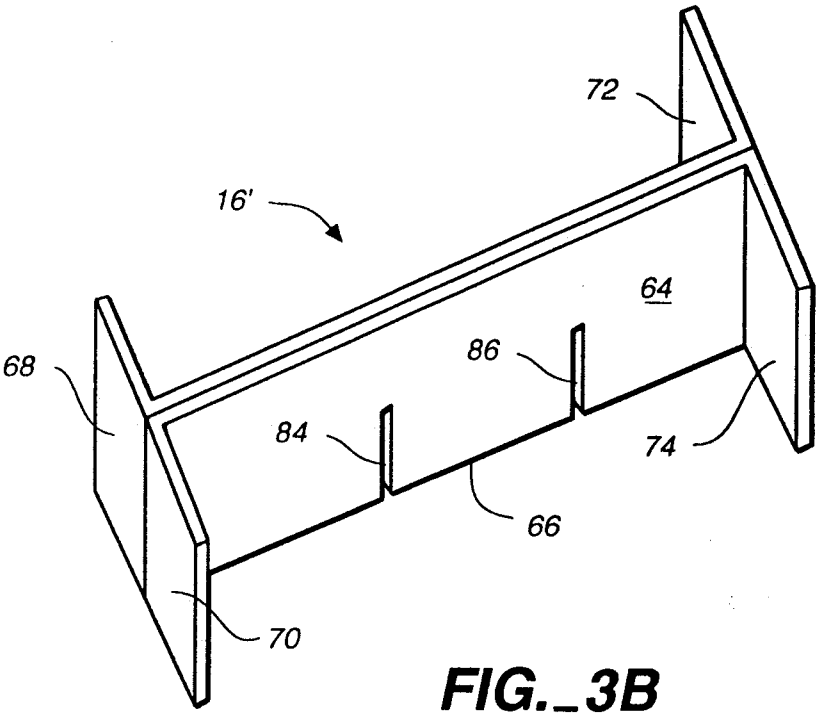
FIG. 3B is a plan view of a blank from which the entire third element of FIG. 3A is formed.
Figure 3A:
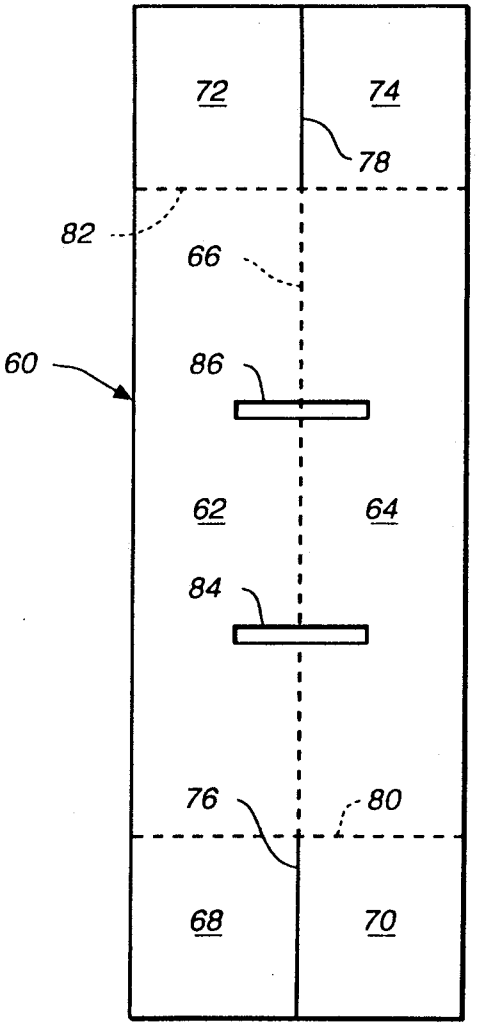
FIG. 3A is a pictorial view of a third element for the alternate embodiment of FIG. 3.

The third element 16' is also illustrated in FIGS. 3A and 3B to better show its construction and arrangement within the carton of FIG. 3.

Referring initially to FIG. 3A, the third element 16' is preferably formed from a single blank 60. The blank includes two straight segments 62 and 64, both corresponding to the straight segment 42 in the third element of FIGS. 1 and 2. The straight segment 62 and 64 are separated by a fold line 66 which may be perforated or scored to facilitate formation of the third element as described in greater detail below.

Two separate end segments 68 and 70 are formed at one end of the blank. Two additional end segments 72 and 74 are similarly formed at the other end of the blank 60. The end segments 68, 70 and 72, 74 are separated from each other by cuts 76 and 78 extending from the ends of the blank 60 to lateral fold lines 80 and 82 separating the straight segment 62 and 64 from the end segments.

Lateral slots 84 and 86 are also formed in the blank 60 spaced evenly apart from each other and the respective fold lines 80 and 82, the slots 84 and 86 extending across the fold line 66 into both of the straight segments 62 and 64. The slots 84 and 86 conform to the slots 54 formed in the third element 16 of the embodiment of FIGS. 1 and 2.

The third element 16' is then formed into a configuration illustrated in FIG. 3B. Referring also to FIG. 3B, the blank 60 is initially folded along the line 66 to form a 90° fold with the two straight segments 62 and 64 being in parallel and abutting relation as illustrated in FIG. 3B. The end segments 68, 70 and 72, 74 and folded outwardly at right angles. Accordingly, each set of end segments has a total length preferably corresponding to the lateral dimension of the first element or bottom panel 12' as illustrated in FIG. 3.

To assemble the carton 10' of the FIG. 3, the second element 14' is arranged upon the first element 12' and preferably within the flange 20' so that the alternate segments 22A, 24, 28 and 30A are parallel to each other and spaced evenly apart along the length of the first element or bottom panel 12'. The third element is then arranged in interconnecting relation with the second element so that the slots 84 and 86 intersect with slots 52' corresponding to the slots 52 in the embodiments of FIGS. 1 and 2.

In this configuration, the second and third elements interact to form six cells as illustrated in FIG. 3. All of the cells are exposed at least through top openings as illustrated to permit display of articles in the cells and removal of articles from the carton as desired.

Either of the carton embodiments 10 or 10' particularly simplifies the manner of forming the carton, filling it with articles to be transported and displayed, transporting the articles to a point of sale and displaying them. That method is briefly described below in order to assure a complete understanding of the invention.

Initially, the carton 10 or 10' is simply assembled in the manner described above by interarrangement of the three elements as illustrated respectively in FIGS. 2 and 3.

The cells of the carton can then be filled with articles 18 or 18' as also illustrated in FIGS. 2 and 3. After the cartons are filled with articles, they may be arranged upon pallets (not shown) and stabilized for example by means of surrounding bands or stretch-wrap (also not shown) if desired.

With the cartons preferably stacked and stabilized upon the pallets, they are then transported to a point of sale. It is of course also possible to transport individual cartons to the point of sale.

Upon arrival at the point of sale, the stretch-wrap and any separate corner posts, if present, are removed so that the cartons are immediately display-ready, preferably upon the pallets referred to above. Because of the construction of the cartons, the articles transported therein are immediately exposed for display while readily permitting removal of the articles as desired by consumers.

Thus, there has been described above two novel embodiments of a transport and display carton together with a method for using the carton in packing, transport and display of articles. Numerous modifications and variations are possible in addition to those specifically noted above. For example, different configurations are possible in both the second and third elements to form multiple cells on the bottom panel formed by the first element. For example, the third element 16' described in connection with FIGS. 3, 3A and 3B could be employed with the second element 14 of FIGS. 1 and 2. Similarly, the third element 16 of FIGS. 1 and 2 could also be employed in combination with the second element 14' of FIG. 3.

Still further modifications are also possible for the embodiments of FIGS. 1_3, 3A and 3B. For example, in the embodiment of FIGS. 3, 3A and 3B, it is contemplated that the second element 14' include at least five segments such as those indicated respectively at 22A, 22', 24', 26' and 28'. It is further contemplated that three alternate segments such as those indicated at 22A, 24 and 28 be arranged in parallel, the second element similarly being intersected by the third element to form at least four cells. In this arrangement, the five segments 22A, 22, 24, 26 and 28 form an S-configuration. Additional pairs of segments could then be added to the second element such as the segments indicated at 30' and 30A in FIG. 3 with the length of the third element 16' and the length of the first element 12' increased to facilitate formation of additional pairs of cells.

A still further modification of the embodiment of FIGS. 3, 3A and 3B would be the formation of additional segments hinged onto the ends of segments 22A and 30A, the additional segments (not shown) extending respectively toward the fold lines 34' and 36' so that all cells in the carton would be completely surrounded while still being exposed through their open tops.

A still further modification is possible in that openings (not shown) could be formed in any of the segments to facilitate display of articles in a generally horizontal direction.

The modifications described immediately above are set forth only for purposes of indicating the types of variations contemplated for the invention. However, the scope of the present invention is defined only by the following claims which are further exemplary of the invention.

What is claimed is:

1. A transport and display carton, comprising a first generally rectangular element forming a bottom panel for the carton, a second elongated rectangular element integrally including five segments and four interconnecting generally right angle folds to form a rectangular box having one generally common dimension with the bottom panel and another dimension substantially smaller than a corresponding other dimension of the bottom panel, two end segments of the second element overlapping each other to form one side of the box, and a third rectangular element having a first straight segment intersecting the box of the second element to divide it into two cells and extending substantially along the other dimension of the bottom panel with end segments integrally forming right angle folds whereby the second and third elements form six exposed cells on the bottom panel for receiving articles to be transported and displayed, the second and third elements being substantially the same height when arranged on the bottom panel with their right angle folds cooperating to provide structural rigidity for the carton, whereby waste material is minimized during formation of the carton and time necessary to assemble and fill the carton is minimized.

2. The transport and display carton of claim 1 wherein the first rectangular element is formed with a peripheral flange.

3. The transport and display carton of claim 2 wherein the second and third elements have points of intersection with each other and opposing slots at their points of intersection to form interacting joints further contributing to structural rigidity of the carton.

4. A transport and display carton, comprising a first generally rectangular element forming a bottom panel for the carton, a second elongated element integrally including five segments and four interconnecting generally right angle folds, the second rectangular element being arranged on the bottom panel formed by the first element with three alternate segments arranged parallel to each other and in generally equally spaced apart relation in the bottom panel, and a third rectangular element having a first straight segment intersecting a central one of the parallel segments of the second element and extending between the other two parallel segments to form four exposed cells on the bottom panel for receiving articles to be transported and displayed, the third rectangular element including a second straight segment parallel to and interconnected with the first straight segment by means of a 180° fold line, the two straight segments including four end segments, two of the four end segments extending in opposite directions at each end of the bottom panel formed by the first element.

* * * * *